United States Patent [19]

Fuchs

[11] Patent Number: 4,878,471

[45] Date of Patent: Nov. 7, 1989

[54] DIESEL FUEL INJECTION DEVICE WITH PREINJECTION

[75] Inventor: Peter Fuchs, Adlikon, Switzerland

[73] Assignee: Nova-Werke AG, Effretikon, Switzerland

[21] Appl. No.: 210,493

[22] PCT Filed: Sep. 4, 1987

[86] PCT No.: PCT/CH87/00112

§ 371 Date: Jul. 8, 1988

§ 102(e) Date: Jul. 8, 1988

[87] PCT Pub. No.: WO88/02066

PCT Pub. Date: Mar. 24, 1988

[30] Foreign Application Priority Data

Sep. 9, 1986 [CH] Switzerland ..... 03617/86

[51] Int. Cl.[4] ..... F02M 39/00

[52] U.S. Cl. ..... 123/446; 123/500; 123/506; 123/300

[58] Field of Search ..... 123/446, 447, 500, 501, 123/506, 458, 445, 299, 300

[56] References Cited

U.S. PATENT DOCUMENTS

| | | | |
|---|---|---|---|
| 4,012,893 | 9/1986 | Ishibashi | 123/506 |
| 4,275,087 | 6/1981 | Goloff | 123/446 |
| 4,417,557 | 11/1983 | Walter | 123/446 |
| 4,425,893 | 1/1984 | McJones | 123/446 |
| 4,426,198 | 1/1984 | Bastenhof et al. . | |
| 4,499,876 | 2/1985 | Yamamoto | 123/446 |
| 4,541,385 | 9/1985 | Eheim | 123/446 |
| 4,667,638 | 5/1987 | Ioashira | 123/446 |
| 4,711,216 | 12/1987 | Takeuchi | 123/446 |

FOREIGN PATENT DOCUMENTS

| | | |
|---|---|---|
| 2496170 | 6/1982 | France . |
| 352531 | 4/1961 | Switzerland . |

*Primary Examiner*—Carl Stuart Miller

*Attorney, Agent, or Firm*—Tarolli, Sundheim & Cóvell

[57] ABSTRACT

A fuel injector (3) is driven by a fluid drive system (27) with a drive unit (28). Connected with the fluid drive system (27) is a first control device (38) which has main and auxiliary slides. The fluid in the fluid drive system (27) is independent of the fuel system. Return pistons (72, 74) of the first control device are connected with relief passages (11, 12) on the housing (4) of the fuel injector (3) and with a second control device (50). On the outer periphery of the plunger (7) of the fuel injector (3) are arranged several annular grooves (18, 19, 20) which are connected with the pump chamber (6). The annular grooves (18, 19, 20) cooperate with the relief passages (11, 12) and have control edges. At least one of the annular grooves (18) effects an interruption of the injection of fuel through the nozzle (1). Several valves (51, 53) in the second control device (50) regulate the pressure in the pump chamber (6) and control the inflow and outflow of fuel. Pressure surges in the relief passages (11, 12) effect control movements in the first and second control devices (38, 50).

16 Claims, 3 Drawing Sheets

DIESEL FUEL INJECTION DEVICE WITH PREINJECTION

BACKGROUND OF THE INVENTION

1. Field of the Invention

The invention relates to a fuel injection device for a diesel internal combustion engine. The fuel injection device includes an injection nozzle connected to a fuel injector through a pressure line. The fuel injector has a housing with at least one fuel line for the inflow and outflow of fuel, a pump chamber, and a plunger. The plunger has at least one annular groove with two control edges fluidly connected with the pump chamber. The housing has a relief passage for interrupting pressure build-up in the pump chamber.

2. Description of the Prior Art

It is known that fuel injection devices are used in internal combustion engines, in which the main injection phase is preceded by a preinjection phase, are used in internal combustion engines Thus, the load on the engine parts is reduced and the combustion process in the internal combustion engine is improved U.S. Pat. No. 4,426,198 discloses such an injection device The injection device disclosed in U.S. Pat. No. 4,426,198 includes a plunger with an oblique control edge. The plunger is driven by a camshaft. The injector housing is provided with a fuel chamber, into which open inlet passages for the fuel, and from which a pressure line leads to the injection nozzle. The end surface of the plunger and edges of a first annular groove on the periphery of the plunger form control edges, and cooperate in a known manner with the inlet passages. A second annular groove, is connected with the fuel chamber and is located below the first annular groove with an oblique edge. The second annular groove is also connected with the fuel chamber. A relief passage is fluidly connected with the outlet line for fuel With the beginning of the injection cycle, the inlet line for fuel and the relief passage are closed by the plunger, and pressure builds up in the fuel chamber. This pressure drops again as soon as the lower groove opens the relief passage, by which the injection cycle is interrupted. The duration of the interruption depends on the dimensions of the second groove and the speed of movement of the plunger. The interruption takes place at a moment at which the plunger already has a relatively high speed. The camshaft accelerates and moves the plunger farther, and movement of the plunger is wasted. So that the fuel in the fuel chamber can flow out, the groove and the relief passage must have relatively large dimensions, which leads to increased leakage.

As soon as the relief passage is closed again a pressure surge results from the high plunger speed and is transmitted to the camshaft which can lead to additional harmful loads on the camshaft. The high forces, caused by the pumping pressure, for example, at 2000 bar injection pressure, cause torsional vibrations as a result of pressure line deviations, which displace the beginning of injection dynamically by several degrees crank angle. With high plunger speeds, and especially with high speed engines, other disadvantages occur, such as, the relief passage being passed over so quickly by the second groove that the drop of pressure no longer takes place correctly. In large engines, the forces acting on the camshaft are so great that special measures are necessary and the construction of shafts and cams becomes very expensive. The forces acting on the camshaft and the speed of movement of the plunger limit the stroke distance of the plunger and also the maximum pressure which can be produced in the fuel chamber.

SUMMARY OF THE INVENTION

The present invention addresses the problem of providing a fuel injection device which permits, instead of the mechanical camshaft drive, the use of a drive acted on by fluid pressure, and in which the plunger speed during the interruption phase is reduced, and the total stroke distance of the plunger increased, and at the same time, increases the injection pressure. The fuel injection device also makes possible the exact interruption of the injection cycle, even in high speed engines and allows the varying of the preinjection, interruption and main injection phases, dependent on operation conditions. The fuel injection device also has a mechanical backup system.

The fuel injection device according to the present invention is distinguished because the plunger is connected with a drive system which is operated by fluid pressure, independent of the fuel system. The drive system includes an axially movable piston, a pressure source, and a first control device, which can be moved mechanically and/or electrically, with a main slide and an auxiliary slide. The main and auxiliary slides each have a return piston, which are connected through a line with the pump chamber and are acted on by fuel pressure. In the fuel line to the pump, a second control device, with an inlet relief valve and at least one interruption valve, is arranged. The inlet relief valve has at least one switching piston having an associated chamber connected through a first line with the relief passage on the injector housing of the fuel system and the pump chamber connected through a second line with the interruption valve.

According to the invention, the drive system, acted on by fluid pressure, has a first control device, with a main and an auxiliary slide, which regulate the flow of fluid pressure, to and from the drive system. The fluid drive system is separate from the fuel system and allows the use of an especially suitable fluid, such as high-pressure hydraulic oil, for example. The fuel system of the injector device and the fluid drive system are systems independent of each other, which are only linked with each other through the return pistons of the first control device. The main and auxiliary slides of the first control device have return pistons which are connected with the pump chamber and acted on by fuel pressure. The connection line from the pump chamber to the return piston chambers of the control device allows the fuel system to directly influence the fluid drive system. Depending on the location of the plunger or the control edges arranged thereon, the first control device, at a desired moment, is acted on by fuel under high pressure, and controls the fluid drive system. The second control device, arranged in the fuel system, allows the control of the flow of fuel in and out the pump chamber, and, at the same time, influences the first control system, depending on the pressure in the pump chamber. This arrangement has the advantage that the phases of the injection cycle are controlled directly with the aid of the fuel pressure and the plunger movement. The relief passages in the injector housing are used only for the transmission of pressure surges, and the fuel injector device allows, therefore, very high plunger speeds and the use of all kinds of fuel. As a further advantage, by means of the interruption valve on the second control device, the length of the interruption phase may be varied during the injection cycle.

A preferred embodiment of the invention is distinguished by the fact that the injector housing has at least one fuel feed line to the pump chamber, a first relief passage in an area of travel of the plunger, and a second relief passage located further from the pump chamber than the first relief passage. The relief passages are parts of the lines between pump chamber and return pistons and the switching piston unit. On the periphery of the plunger are arranged three annular grooves, with two control edges each, and connected through a channel with the pump chamber. A connection line with a check valve is located between the chamber of the return piston on the auxiliary slide and the chamber of the return piston on the main slide. The chamber of the return piston on the auxiliary slide is connected, through another line with the chamber of the switching piston of the second control device The arrangement of three annular grooves with control edges on the plunger and of two relief passages on the injector housing makes possible the correct actuation of the main and auxiliary slides of the first control device and the switching piston in the second control device. Additional interruptions of the injection cycle can be obtained through the location of other annular grooves with control edges. The relief passage and the annular grooves serve only to transfer the pressure surges with only very small flow amounts they may have small dimensions.

According to another embodiment of the invention, the main slide has three annular grooves defined by blocking seats and two connected lands. The auxiliary slide has two annular grooves defined by one blocking seat and a land. The middle annular groove of the main slide, and one of the annular grooves of the auxiliary slide are connected. A pressure line and a return line are connected, each to one of the other annular chambers of the main slide. The second annular chamber of the auxiliary slide is connected through a line with the drive system. Another improvement of the fuel injection device can be obtained by the fact that, in a first switching position of the main slide, a land blocks the pressure line. The return line is connected by the connection line to one of the annular chambers of the auxiliary slide. In a second switching position the other land blocks the return line, and the pressure line is connected, by the connection line, to the auxiliary slide. Suitably, the land of the auxiliary slide has a restrictor passage, and this restrictor passage connects the two annular chambers with each other when the blocking seat is closed.

A preferred embodiment of the invention is distinguished by the fact that in a first switching position of the auxiliary slide, the land opens the blocking seat and the line to the drive system is connected directly with the line to the main slide. In a second switching position, the land blocks the line to the drive system, and a limited flow channel is formed through the restrictor passage between the two annular chambers.

In the first switching position, the full volume flows to the drive system and moves the plunger at the normal speed. The second switching position is taken by the auxiliary slide when the first groove on the plunger cooperates with the first relief passage on the injector housing. Thus, fuel under pressure, pushes the auxiliary slide through the return piston. The restrictor passage, arranged in the land of the auxiliary slide, allows, in this position, only a reduced volume of flow from the fluid source to the driven unit. The speed of movement of the plunger is thereby reduced, while this reduction can be controlled by varying the cross section of the restriction. This gives the advantage that, during the interruption phase of the injection cycle, practically no stroke volume or work distance of the plunger is wasted.

Other improvements of the fuel injection device are distinguished the second control unit having two interruption valves, each provided with a control piston. Between the valve chamber of one of the interruption valves and its piston chamber, a connection passage is present, and in this connection passage is arranged an auxiliary valve. The piston chamber of the second interruption valve is connected through a line with the lower relief passage on the injector housing and a spring opens the valve in pressureless condition. Preferably, the second interruption valve is provided with a spindle, extending from the control unit. The piston of the auxiliary valve is biased by a spring, and in the pressureless condition, the valve is open, while the chamber is connected through a line with the connection passage between main and auxiliary slides, and there is built into this line a switching valve with a connection to the return line.

The two interruption valves, or their chambers, are connected through lines with the fuel system and the pump chamber, and are controlled by pressure surges. These two valves are switched so that one is open and the other closed. This arrangement allows very rapid switching, since during the opening movement of one interruption valve, the other can already be closed, and vice versa. Also, the second control unit and the injector remain functional, even with failure of the control elements. Instead of, or supplementing the hydraulic control, the interruption valves may also be controlled indirectly, mechanically or electrically. The direct hydraulic control has the advantage that no additional switching means is necessary, and thus, outside influences on the control are reduced. The switching valve which controls the auxiliary valve, is a hydraulic valve which, in the known way, is actuated electrically. The electric signals are produced in the known way by a crank drive, a pulse generator or other power-dependent measuring points. A camshaft is also suitable for the control of the hydraulic valve.

In another embodiment, in the passage connected with the fuel line is arranged a check valve. The valve blocks the passage leading to the interruption valve, and has a free passage in the direction of the bore. This arrangement has the advantage that pressure surges which occur in the passage connected with the fuel line, cannot act on the interruption valve. In this way, undesired opening of this valve is prevented.

In further developement of the invention, the lands of the main slide are connected with a push rod. At least a part of the push rod forms the core of a magnetic coil, and this magnetic coil is connected with an electric pulse generator and/or the push rod is part of a mechanical blocking device. The blocking device retains the push rod and the land of the main slide in a control position.

The invention is further distinguished by the fact that the control device in the hydraulic system is connected with a camshaft control, and the camshaft acts on the push rod of the control device. With this arrangement, a light-weight camshaft may be used, since it need move only control elements. This is unlike the case in injection devices in which the camshaft directly drives the plunger, and a heavy, expensive construction is required. The control camshaft acts directly on the push rod of the main slide, and serves as an actuation element of the main slide or as an emergency control with failure of the magnetic coil. In a further developement of the invention, the drive piston is double-acting and the feeding of fluid to a work chamber for fully acting on a piston surface is conducted through the control device from the pressure source. The feeding of fluid is fed directly from the pressure source to an annular groove for acting on the annular surface of the piston.

In the operation of the fuel injection device according to the invention, the plunger, by means of a control device, known per se, is rotated on its longitudinal axis, dependent on the engine load, and brought into a position in which the control edges effect the injection of the desired amount of fuel. The start of the injection cycle is effected through the first control device in the fluid drive system, by means of an electric pulse through the magnetic coil or by means of the control camshaft. The first control device opens the inflow of fluid to the drive piston unit. This moves the plunger, while the fuel in the pump chamber is put under pressure. At a certain pressure, the control valve to the injection nozzle opens, and the fuel is injected, under pressure up to 2000 bars, into the diesel internal combustion engine. When the plunger has travelled a predetermined distance, the control edge on the first annular groove and the pump chamber are coupled, through the first relief passage and the connection lines, with the two control devices, and the sudden pressure surge, travelling at sonic speed causes, through the return piston in the first control device a return of the auxiliary slide, to block the flow of fluid to the working surface of the drive piston. The advance of the drive piston and the plunger takes place now only through the reduced flow of fluid through the restrictor passage of the auxiliary slide. At the same time, the pressure surge acts on the switching piston unit of the second control device and opens the inlet relief valve. In this way, the pressure prevailing in the pump chamber is relieved through the feed line into the fuel outlet line, and the injection cycle is interrupted. If the first annular groove on the periphery of the plunger is arranged obliquely, the preinjection phase can be adjusted in the known way by rotating the plunger around its longitudinal axis. As soon as the lower control edge of the first annular groove has passed the relief passage, the plunger is ready for the continuation of injection, and moves at reduced speed. At a desired moment, the closed interruption valve is opened, and thus, the chamber of the switching piston unit is relieved. This has the result that the return piston on the auxiliary slide of the first control unit is also relieved, and the spring biased land is pushed back into its first switching position. With this, the full flow of fluid again reaches the drive piston, and the movement of the plunger is continued at full speed. The inlet relief valve closes at once, and pressure is built up again in the pump chamber. At the desired injection pressure, the control valve opens the feed line to the injection nozzle, and the main injection phase begins. During this phase, the interruption valve in the second control device is closed again.

As soon as the control edge of the second annular groove reaches the first relief passage, the inlet relief valve is opened again, as described, and the main injection phase is interrupted. The third annular groove on the plunger is arranged parallel to the second, and the control edges of the two annular grooves have the same distances apart as the first and second relief passages. Through the connection lines, therefore, the pressure surge arrives at the same time to the two return pistons of the auxiliary and the main slides on the first control device, as well as the switching piston unit of the second control device. The main slide opens the return in the fluid drive system and this has the result that, with the opening of the inlet relief valve in the fuel system, the drive piston at once stops and returns. This assures the immediate closing of the injection line and prevents pumping back. The plunger and the drive piston are moved into their original positions at bottom dead center. In the bottom dead center position of the plunger, the control edge on the end surface of the piston lies below the first relief passage. Thus, the entire fuel system, including the return piston, is under the same pressure. The auxiliary slide also moves into its starting position, and the control devices are ready for the next work stroke.

In the device according to the invention, the stroke of the plunger is not limited by mechanical elements. Therefore, the plunger may have a smaller diameter and a greater stroke than the known devices. This gives more space for the control edges, which simplifies production and adjustment. Because of the volumetric determination of the amount of fuel injected, this fuel injection device is extremely exact. The start of the injection cycle can be fixed exactly, by known and tested means, and transmitted to the first control device. Through the separation of the fuel system from the fluid drive system, the use of special hydraulic oils or other fluids is possible, which assures the long life desired in fuel injection devices. The combination of the oblique edge control on the plunger with a drive system acted on by a fluid pressure gives a very high safety of operation and independence of construction. One great advantage of this fuel injection device is that all elements of construction can be arranged axially with each other, and with the arrangement of several injection devices, each is independent of the others. Heavy, expensive drive camshafts are completely eliminated, which is important, especially in large and high speed diesel engines. Nevertheless, backup control is provided through camshaft controls with a light camshaft.

BRIEF DESCRIPTION OF THE DRAWINGS

The present invention is described in detail below with reference to the attached drawings, in which.

DESCRIPTION OF PREFERRED EMBODIMENTS

Figure 1:
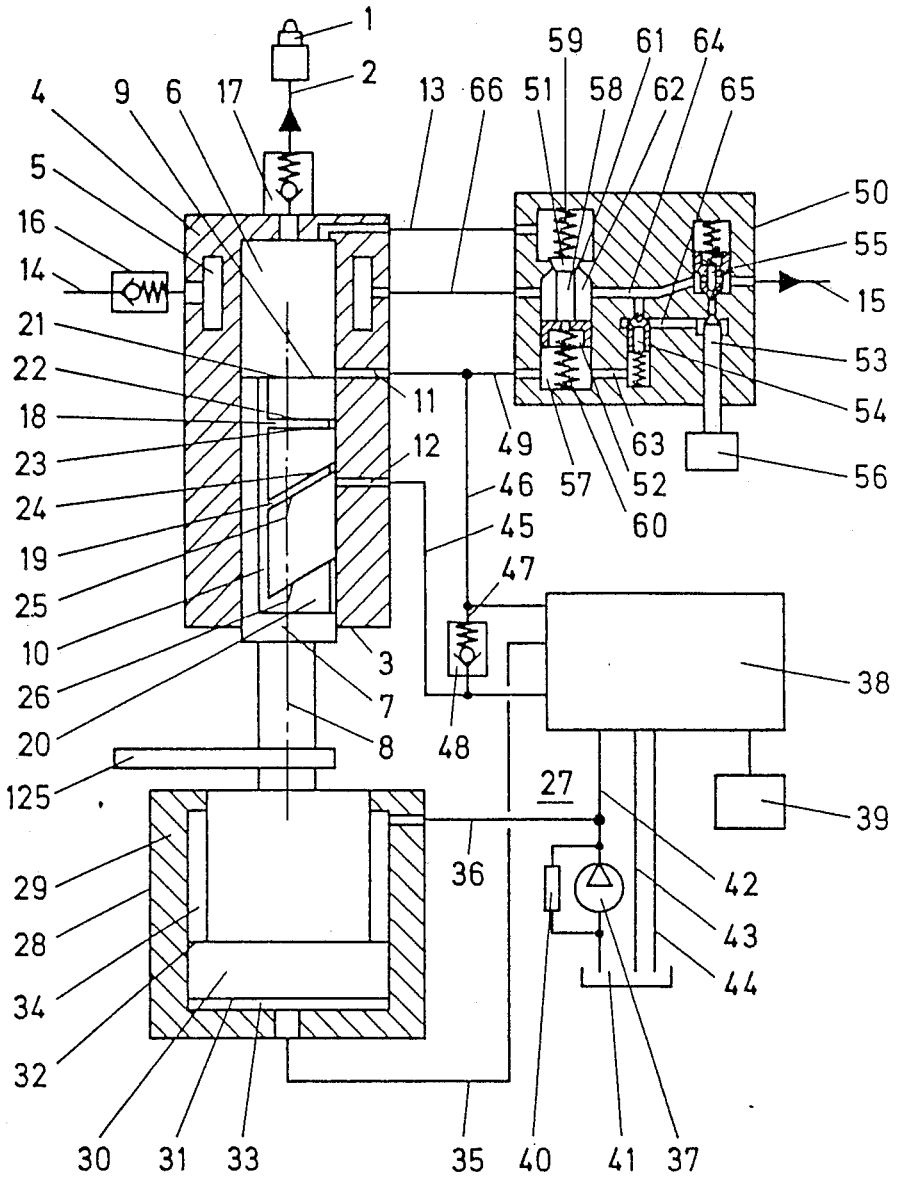
FIG. 1 is a schematic illustration of the fuel injection device according to the present invention.

The fuel injection device illustrated in FIG. 1 has a fuel injector 3, a drive system 28, a first control device 38, a second control device 50 and a nozzle 1. The fuel injector 3 includes an injector housing 4, a pump chamber 6, a plunger 7, and a fuel line. The fuel line consists of a fuel inlet line 14, a check valve 16, a fuel channel 5, a flow through line 66, a feed line 13 and a fuel outlet line 15. At the upper end of the injector housing 4, as viewed in FIG. 1, is arranged a pressure line 2, which contains a control valve 17 and leads to the nozzle 1. The feed line 13 is connected to the upper end of the pump chamber 6. Three annular grooves 18, 19, 20, are located in the outer periphery of the plunger 7 and are connected through a channel 10 with the pump chamber 6. The first groove 18 has control edges 22, 23. The second groove 19 has control edges 24, 25. The third groove 20 has a control edge 26. The upper end surface 9 of the plunger 7 forms a first control edge 21. A first relief passage 11 and a second relief passage 12 are located in the injector housing 4. When the plunger 7 is in its bottom dead center position the upper end surface 9 of the plunger 7 is below the first relief passage 11, as illustrated in FIG. 1, the pump chamber 6 is in fluid communication with the first relief passage 11. The second relief passage 12 is located at a distance from the first relief passage 11 which corresponds to the maximum stroke of the plunger 7. The plunger 7 can also rotate around its longitudinal central axis 8, for which a known adjusting device 125 is provided. The plunger 7 is connected at its lower end with the drive system 28 of drive assembly 27.

The drive system 28 consists of a cylinder 29 and a double-acting piston 30. The cylinder 29 is connected, through lines 35, 36, to a fluid pressure source 37 of the drive system 27. The double-acting piston 30 has a surface 31 located in a work chamber 33. The piston 30 also has an oppositely facing annular surface 32 associated with an annular chamber 34. The drive system 27 is driven by any known fluid pressure and forms a fluid pressure system. In the preferred embodiment, high-pressure hydraulic oil is used. The fluid pressure system includes the first control device 38, a pressure line 42, a return line 43 and a leakage line 44. The pressure line 35, which opens into the work chamber 33 of the axial piston unit 28, is also connected with the first control device 38. Also connected to the first control device 38 are connection lines 45, 46, which lead to the relief bores 11 and 12 on the pump cylinder 4. The connection lines 45, 46 are connected with each other through another connection line 47, in which a check valve 48 is located. The check valve 48 prevents the fuel from flowing from the line 46 to the line 45, or to the main slide. An electric pulse generator 39 is connected with the first control device 38. The pulse generator 39 is connected in the known way with the measuring and control elements of the internal combustion engine, and controls the injection cycle as necessary. A pressure regulating valve 40 and a fluid reservoir tank 41 are connected with the pressure source 37 of the device assembly 27, in a known way.

The connection line 46, flow through line 66 and the feed line 13 are connected with the second control device 50. The second control device 50 has a passage 64 which is connected with the flow line 66 and with the fuel outlet line 15. An inlet relief valve 51 is located in the passage 64. The inlet relief valve 51 has a valve seat 61, a valve shaft 58 and a switching piston 52. When the inlet relief valve 51 is moved off the valve seat 61, the fuel can flow from the fuel inlet line 14 through the flow line 66, the valve seat 61 and the feed line 13 into the pump chamber 6. For supplying the fuel inflow, there is connected to the fuel inlet line 14 a fuel pump (not shown), which provides the fuel at low pressure in the fuel system. The inlet relief valve 51 is biased by a spring 59, which closes the valve seat 61. The switching piston 52 is located in an overflow chamber 62 and engages the valve shaft 58. Below the switching piston 52, a piston chamber 57 is formed, which is connected through a line 49 with the connection line 46 and the relief passage 11. A spring 60 in the piston chamber 57 presses the switching piston 52 against the valve shaft 58, and relieves and holds in equilibrium the inlet relief valve 51 against the biasing force of the spring 59. The piston chamber 57 is also connected, through the passages 63, 65 and an interruption valve 53, with the passage 64 of the outlet fuel line 15. Between the passages 63 and 65 is interposed a compensating valve 54, which facilitates the flowing back of the fuel into the different passages. A check valve 55, arranged opposite the interruption valve 53, prevents the pressure surge in the passage 64 from thrusting open the closed interruption valve 53. Such pressure surges can occur when the inlet relief valve 51 is opened into the pump chamber 6 at high pressure, and the pump pressure flows away through the feed line 13 into the passage 64 and the fuel outlet line 15. According to the pressure in the pump chamber 6, such pressure surges may briefly reach 200 bars. The interruption valve 53 is actuated through a controller 56, which is a known electric control or a mechanical controller, connected with the camshaft control acting on the first control device 38.

Figure 2:
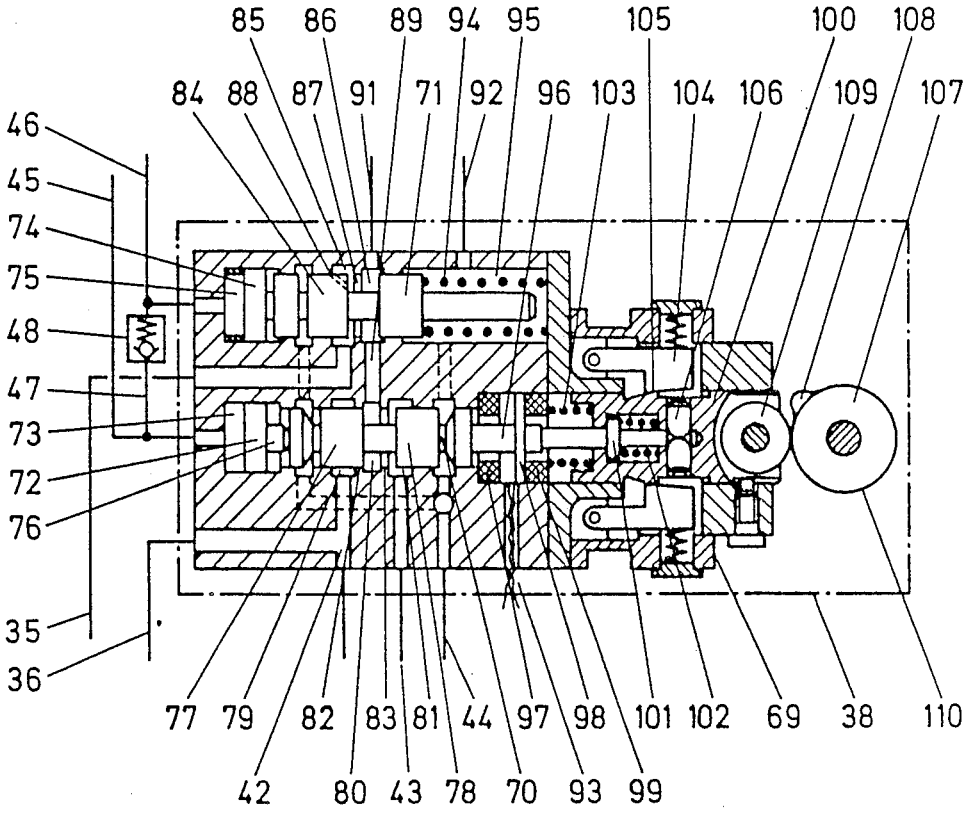
FIG. 2 is a cross sectional view of a first control device of the system illustrated in FIG. 1.

The first control device 38 is illustrated in FIG. 2 and consists mainly of a main slide 70, an auxiliary slide 71, a mechanical blocking device 69 and a camshaft control 110. The main slide 70 has two lands 77, 78 with control edges which cooperate with blocking seats 82, 83 on the housing of the first control device 38. With the land 77 is associated with an annular chamber 79, and with the land 78 an annular chamber 81. Between these is a third annular chamber 80. Pressure relief chambers and sealing pistons are located axially outward of the lands 77 and 78. The pressure relief chambers are connected with a leakage line 44. The lands 77, 78 and the sealing pistons are held at the proper mutual distance and connected together by means of a core. The annular chamber 81 is connected with the return line 43, the annular chamber 79 with the pressure lines 42 and 36, and the annular chamber 80, through a connection line 89, with an annular chamber 86 of the auxiliary slide 71. At one end of the main slide 70 is arranged a push rod 96 which is connected with the lands 77, 78. A part of the push rod 96 forms the core 98 of a magnetic coil 97. The push rod 96 extends beyond the magnetic coil 97, and is surrounded by the mechanical blocking device 69. The camshaft control 110 is connected with the mechanical blocking device 69.

On the opposite side of the main slide 70, a return piston 72 cooperates, through a pin 76, with the lands 77, 78. A piston chamber 73 associated with the return piston 72, is connected through the line 45, with the fuel system. The connection line 45, as shown in FIG. 1, communicates with the relief passage 12 in the injector housing 4, which leads into the pump chamber 6. Through the connection line 47 and the check valve 48, the piston chamber 73 is also connected with the connection line 46 and thus the relief passage 11 in the injector housing 4, or with the piston chamber 57 in the second control device 50.

The auxiliary slide 71 has a land 84 and two annular chambers 85, 86. Pressure relief chambers and sealing pistons are located axially outward of the land 84 associated with the annular chambers 85, 86. The pressure relief chambers are connected with the leakage line 44. Between the two annular chambers 85, 86 is a blocking seat 87. Through the connection line 89 is connected the annular chamber 86, depending on the position of the main slide 70, with the pressure line 42 or with the return line 43. From the annular chamber 85 runs the fluid pressure line 35 which leads to the work chamber 33 of the drive system 28. In the land 84 is a restrictor passage 88 which, even with the blocking seat 87 closed, makes possible a reduced flow of hydraulic oil from the annular chamber 86 into the annular chamber 85 and vice versa. The auxiliary slide 71 also cooperates at one end with a return piston 74. A piston chamber 75, associated with the return piston 74, is connected, through the line 46, with the fuel system or with the relief passage 11 on the injector housing 4, and the piston chamber 57 on the second control device 50. At the axially opposite end, the auxiliary slide 71 is biased by a spring 94, arranged in a leakage chamber 95, which moves the auxiliary slide 71 back into an initial position in each case.

In addition to the two slides 71, 72, illustrated in FIG. 2 is the mechanical blocking device 69 and the camshaft control 110. The mechanical blocking device 69 includes a blocking housing 100, catches 104, and release bolts 106. The push rod 96 projects into the blocking housing 100 and has a shoulder 101. If the push rod 96 is pushed to the left by means of the magnetic coil 97, the shoulder 101 carries along the blocking housing 100, and the spring biased catches 104 lodge in the cams 105 and hold the blocking housing 100 in this position. In this way, the feeding of current to the magnetic coil 97 can be interrupted, and there is no danger of overload or overheating. The return of the push rod 96 takes place at the end of the injection cycle through the return piston 72, being acted on by the injection pressure. With this, the push rod 96 is urged to the right against the biasing force of the spring 102, and the release bolts 106 are driven outwardly from the end of the push rod 96. The release bolts 106 lift the blocking catches 104, and free the cams 105 on the blocking housing 100. The spring 103 then urges the blocking housing 100 back into its initial position.

In addition to the magnetic coil 97 of the injection control there is the camshaft control 110. This consists of the camshaft 107 with a cam 108, and a roller follower 109, fastened to the control housing 100. The camshaft 107 is driven by a drive (not shown) which is connected with the crank drive. In case of failure of the electric pulse generator 39 or the magnetic coil 97, or a failure of current, the cam 108 drives the blocking housing 100, through the roller follower 105, and thus pushes the push rod 96 to the left at the beginning of the injection cycle. The movement of the blocking housing 100 and of the push rod 96, requires only slight force, and the camshaft controller 110 may therefore be light and built without great kinematic expense. The return of the push rod 96 at the end of the injection cycle takes place as described above. In the preferred embodiment, a second magnetic coil 99 is arranged beside the magnetic coil 97. Both magnetic coils 97, 99 receive through the electric line 93, electric pulses from the electric pulse generator 39. By actuating the magnetic coil 99 with an electric pulse, the push rod 96 can be pushed to the right and thus the injection cycle interrupted prematurely. This makes possible an emergency stop of the injection device, since by this displacement of the main slide 70, the fluid pressure acting on the drive surface 31 of the drive piston 30 of the drive system 28 is interrupted and the drive piston 30 is urged to its top dead center position.

Figure 3:
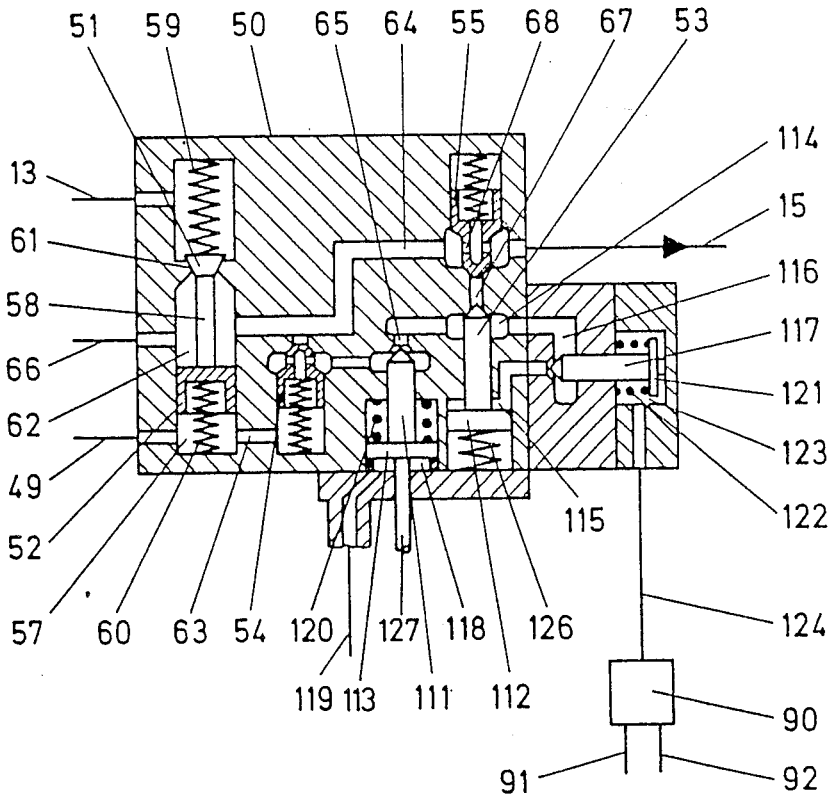
FIG. 3 is a cross sectional view of a second control device of the system illustrated in FIG. 1.

In the second control device 50, illustrated in FIG. 3, is an embodiment which allows higher switching speeds and performs backup functions. This improved control device has, as shown in FIG. 1, an inlet relief valve 51, with a switching piston 52, a compensating valve 54 and a check valve 55. From the flow line 66, fuel flows into the overflow chamber 62 and from there either through the inlet relief valve 51 and the feed line 13 into the pump chamber 6, or through the passage 64 to the fuel line 15. The check valve 55 has an open passage 68, through which the fuel can flow from the passage 64 into the line 15. With the check valve 55 open, the valve chamber 114 is connected through the passage 67 with the fuel outlet 15. The chamber 57 for the switching piston 52 is connected, as shown from FIG. 1, through the line 49, as well as the lines 45 and 46, with the relief passages 11 and 12 in the injector housing 4. In the passages 63, 65, between the chamber 57 and the fuel outlet line 15, there is a second interruption valve 111 in addition t the interruption valve 53. Beside the interruption valve 53 is arranged another auxiliary valve 117. The interruption valve 111 has a control piston 113 and a chamber 118. The chamber 118 is connected, through the line 119, with the line 45 or the relief passage 12. If there is no pressure in the chamber 118, the interruption valve 111 is urged by a spring 120 against the lower stop, and remains open. The interruption valve 53 has a control piston 112 located in a chamber 115, which is connected through the line 116 with the valve chamber 114. The interruption valve 53 is urged by a spring 126 against the valve seat, when no pressure is present in the piston chamber 115, and holds this valve closed in the line 116, between chamber 115 and valve chamber 114, is arranged the auxiliary valve 117, which has a piston 121, a chamber 123 and a spring 122. In the pressureless condition, the spring 122 urges the piston 121 against the stop, and the auxiliary valve 117 remains open. The piston chamber 123 is connected, through the line 124 with a switching valve 90 which, in turn, is connected, through the control lines 91, 92 with the auxiliary slide 71 of the control device 38. The control line 91 opens, as shown in FIG. 2, in the annular chamber 86, and the control line 92 into the leakage chamber 95, connected with the leakage line, on the auxiliary slide 71. The switching valve 90 is a three way-two way valve which is actuated electrically by the pulse generator 39 or mechanically by a camshaft.

The operation of the fuel injection device shown in FIG. 1, takes place so that fuel flows from the fuel inlet line 14 through the fuel channel 5, the line 66, the inlet relief valve 51 and the feed line 13 into the pump chamber 6. Meanwhile, the plunger 7 and the drive piston 30, connected with the plunger 7, are in the bottom dead center position. The main slide 70 of the first control unit 38 is biased by the spring 103 in its initial position and the land 77 closes the connection of the pressure line 42 to the fluid pressure line 35. At the beginning of an injection cycle, the magnetic coil 97 is excited by the electric pulse generator 39 and through the push rod 96 the main slide 70 is pushed in the direction of the return piston 72. The land 77 opens the connection between the annular chamber 79 and the annular chamber 80. The land 78 closes the connection between the annular chamber 80 and the annular chamber 81. With this, fluid flows, under pressure, from the pressure line 42 through the line 89 into the annular chambers 86, 85 associated with the auxiliary slide 71, and into the line 35 and thus into the work chamber 33 of the drive system 28. The piston 30 is pushed upward and forces the plunger 7 toward the upper end of the pump chamber 6. Through this axial movement, the relief passage 11 in the injector housing 4 is closed, and pressure builds up in the pump chamber 6. On reaching a certain pressure, the control valve 17 opens and, through the injection nozzle 1, fuel is injected into the combustion chamber of a diesel internal combustion engine. The pressure prevailing in the pump chamber 6 is fed, through a channel 10, on the outer periphery of the plunger 7, to the grooves 18, 19 and 20. As soon as the groove 18, or its upper control edge 22, reaches relief passage 11, the pressure built up in the pump chamber 6, is propagated as pressure surge through the lines 46 and 49 in the first and second control devices 38 and 50. In the first control device 38, as can be seen from FIG. 2, the return piston 74 is acted on, through the chamber 75, by the pressure surge. In this way, the auxiliary slide 71 is pushed against the biasing force of the spring 94, and the land 84 closes the blocking seat 87. In this position of the auxiliary slide 71, a stream of limited volume can still flow from the pressure line 42, through the restrictor passage 85, into the annular chamber 87 and thus to the piston 30. The plunger 7 moves, therefore, from this moment, only at reduced speed. At the same time, in the second control device 50, the switching piston 52 is acted on, through the piston chamber 57, by pressure surge. The switching piston 52 is pushed upward and, through the valve shaft 58, moves the inlet relief valve 51 from its valve seat 61. The pressure prevailing in the pump chamber 6 expands at once into the overflow chamber 62, the passage 64 and into the fuel line 15. The sudden drop in pressure effects the immediate closing of the control valve 17, and the injection phase is interrupted. The relief passage 11, after a short distance of movement of the plunger 7, is closed again by the lower control edge 23 of the groove 18, and the inlet relief valve 51 is held in the open position by the volume of fuel present in the piston chamber 57. With this, the pressure in the chamber 57 is higher than in the chamber 62. The springs 59, 60 support the movements of the valve 51. Since the groove 18 need serve only for the transmission of a pressure surge, the distance between the control edges 22, 23 may be chosen very small. At the moment when a main injection phase is to be continued, the interruption valve 53 is quickly opened, while the control 56 is actuated. With this, the bore 65 is connected with the fuel outlet line 15, and the auxiliary slide 71 in the first control device 38 can be thrust back into its starting position by the spring 94. Through the same pressure relief, the inlet relief valve 51 is closed. As a result, the full volume stream flows again in the pressure line 35, and the movement of the piston 30, and with it, the plunger 7 is continued at full speed. On reaching the injection pressure, the control valve 17 opens again, and the main phase of injection begins. During this phase, the interruption valve 53 is closed again with the aid of the control 56. The main injection phase continues until the control edges 24 and 26 of the two grooves 19 and 20 reach the relief passages 11 and 12. The two control edges 24 and 26 are arranged the same distance apart as the two relief passages 11 and 12. On reaching this position, the pressure prevailing in the pump chamber 6 is transmitted, in the form of a pressure surge, through the lines 45, 46 and 49, to the two control devices 38 and 50. Through the pressure surge in the line 45 and through the chamber 73, the return piston 72 is acted on, and the main slide 70 moved back to its initial position. The land 77 closes the connection between the annular chambers 79 and 80, and the land 78 opens the connection between the annular chambers 80 and 81, with which the work chamber 33 of the drive system 28, is connected with the return line 43. Since the auxiliary slide 71 has also been pushed by the pressure surge against the return piston 74, the blocking seat 87 is closed by the slide housing 84. Therefore, the fluid can flow back from the work chamber 33, through the line 35 and the restrictor passage 88 only at limited speed, by which the return of the piston 30 is restricted. At the same time, as described above, on the second control device 50, the inlet relief valve 51 opens the valve seat 61, and the pressure in the pump chamber 6 at once drops. As a result, the control valve 17 closes and the main injection phase is ended. The whole fuel system, and thus, the grooves 18, 19 and 20 on the plunger 7, as well as the lines 45, 46, 49, are again at the normal pressure of the fuel pump, and the auxiliary slide 71 is moved back, by means of the spring 94, into the starting position. The land 84 opens the blocking seat 87 and frees the entire cross section of the return flow. The pressure prevailing in the annular chamber 34 of the drive system 28 of the fluid system, moves the piston 30 back, until it again reaches its initial position at the bottom dead center. With this, the device is ready for another injection cycle.

If, as in FIG. 3, two interruption valves 53 and 111 are used in the second control device 50. The switching of the valves 53 and 111 takes place with the aid of pressure surges, branched through the relief passages 11 and 12 of the pump chamber 6. The use of two interruption valves 53, 111, with corresponding control pistons 112, 113, assures operation up to the maximum stroke even in case of failure of the control 56 according to FIG. 1, or the switching valve 90 or its control. Here, the auxiliary valve 117 is open, by force of the spring 122, in the pressureless condition of the chamber 123. When the control edge 22 on the plunger 7 reaches the relief passage 11, the pressure from the pump chamber 6 acts as pressure surge, from the relief passage 11 through the line 49 and the connection line 116, on the control piston 112, and opens the interruption valve 53. As a result of the pressure drop in the chamber 57, the inlet relief valve 51 closes at once, and the injection cycle is continued. With the drop of pressure in the connection line 116, the valve 53 also closes again. The plunger 7 is moved farther upward, while the injection cycle continues. As soon as the control edges 24 and 26 reach the relief passages 11 and 12, the pressure from the pump chamber 6 acts as pressure surge, through the lines 49 and 119. The pressure surge through the line 49 acts on the switching piston 52 and opens the inlet relief valve 51. The second interruption valve 111 is closed at the same time by the pressure surge from the pump chamber 6 through the relief passage 2, the connection line 119 and the impacting of the control piston 113, so that the inlet relief valve remains open and the injection cycle ends. Through the outflow through the inlet relief valve 51 and the subsequent slow suction stroke, the pressure in the whole fuel system and also in the piston chamber drops, so that the valve 111 is driven back by the spring 120, and is open ready for the next advance stroke. With the aid of the spindle 127 on the interruption valve 111, overlapping control movements can be exerted during the injection stroke. Through a known actuation and not shown, of the spindle 127, for example, in connection with the switching piston 90, shorter switching intervals for the inlet relief valve 51 can be given. During the opening process of the first interruption valve 53, the second interruption valve 111 may be already closed, and vice versa. The open interruption valve 111 is held open, while the auxiliary valve 117 is closed. The switching valve 90 provides for the auxiliary valve 117 being opened, and thus the interruption valve 117 closed, at the right moment. The control of the switching valve 90 for the auxiliary valve 117 takes place, in the example shown, in the known way, dependent on power and engine speed, like the control of the adjusting device 125 on the plunger 7. The combination of these two possibilities of adjustment permits the varying of the preinjection, interruption and main injection phases in a wider range. With the use of two interruption valves 53 and 111 on the second control device 50, still more grooves with control edges can be arranged on the plunger 7, through which other interruption phases may be introduced into the injection cycle. As a result of the long possible stroke of the plunger 7, such grooves may easily be arranged in the known way.

I claim:

1. A fuel injection device for a diesel engine in which an injection nozzle is connected through a pressure line to an injector, which injector has a housing with at least one fuel line for the inflow and outflow of fuel, a pump chamber and a plunger, in which the plunger has at least one annular groove with two control edges and is fluidly connected with the pump chamber, and the housing has a corresponding relief passage for the interruption of pressure build-up in the pump chamber, with the distinction that the plunger (7) is connected with a fluid drive system (27) independent of the fuel system; said drive system (27) includes a drive unit (28), a pressure source (37), and a first control device (38) which can be actuated mechanically and electrically, said first control device (38) including a main slide valve (70) and an auxiliary slide valve (71); said main and auxiliary slide valves each having a return piston (72, 74) acted on by fuel pressure from the pump chamber (6) through a respective line (45, 46); a second control device (50) being located in a fuel line (5, 15) on the injector (3) and includes an inlet relief valve (51) and at least one interruption valve (53), said inlet relief valve (51) having a switching piston (52) located in piston chamber (57) which is connected through a first line (49) with a first relief passage (11) on the injector housing (4) communicating with the pump chamber (6) and connected with the fuel line (15) through a second line (63, 65) having said interruption valve (53) located therein.

2. The fuel injection device according to claim 1 further including a fuel feed line (13) connected with the pump chamber (6) wherein said first relief passage (11) being located in the injector housing (4) in an area traversed by movement of the plunger (7) for conducting fluid pressure from the pump chamber (6) to return piston (74) and to the switching piston (52), and further including a second relief passage (12) located in the injector housing (4) in an area adjacent the periphery of the plunger (7) for conducting fluid pressure from the pump chamber (6) to the return piston (72) and are arranged three annular grooves (18, 19, 20) located on the outer periphery of the plunger (7) each of said grooves having two control edges and being connected through a channel (10) with the pump chamber (6) for conducting pressure in the pump chamber (6) to said relief passages (11, 12) during axial movement of the plunger (7).

3. The fuel injection device according to claim 1 further including a connection line (47) having a check valve (48) located between a piston chamber (75) for the return piston (74) on the auxiliary slide valve (71) and a piston chamber (73) for the return piston (72) on the main slide valve (70), and said piston chamber (75) of the return piston (74) on the auxiliary slide valve (71) being connected through a line (46, 49) with a piston chamber (57) of said switching piston (52) of the second control device (50).

4. The fuel injection device according to claim 1 further including three annular chambers (79, 80, 81) associated with the main slide valve (70) defined by blocking seats (82, 83) and two lands (77, 78) which are connected together and two annular chambers (85, 86) associated with the auxiliary slide valve (71) defined by a blocking seat (87) and a land (84); a connection line (89) being located between middle annular chamber (80) of the main slide valve (70) and one of said annular chambers (86) of the auxiliary slide valve (71), a pressure line (42) being connected to annular chamber (79) and a return line (43) being connected to the annular chamber (81), and a line (35) connects the drive unit with the second annular chamber (85) of the auxiliary slide valve (71).

5. Fuel injection device according to claim 4 wherein when said main slide valve (70) is in a first switching position, said land (77) blocks the pressure line (42), and the return line (43) is fluidly connected by the connection line (89) with one of the annular chambers (86) of the auxiliary slide valve (71) and when the main slide valve (70) is in a second switching position said other land (78) blocks the return line (43) and the pressure line (42) is fluidly connected by the connection line (89) with the auxiliary slide valve (71).

6. The fuel injection device according to claim 4 further including a restrictor passage (88) in said land (84) of the auxiliary slide valve (71) for connecting the two annular chambers (85, 86) together when the blocking seat (87) is closed.

7. The fuel injection device according to claim 4 wherein when the auxiliary slide valve (71) is in a first switching position said land (84) opens the blocking seat (87) so the line (35) to the drive unit (28) is connected directly with the connection line (89) to the main slide valve (70), and when the auxiliary slide valve (71) is in a second switching position said land (84) blocks the line (35) to the axial piston unit (28) and forms a limited flow path between the two annular chambers (85, 86) through the restrictor passage (86).

8. The fuel injection device according to claim 1 wherein said second control unit (50) further includes two interruption valves (53, 111) in which each of said interruption valves (53, 111) has a respective control piston (112, 113) and an auxiliary valve (117) is located in a line (116) connecting a valve chamber (114) of the one of said interruption valves (53) and a piston chamber (115) of said one interruption valve (53).

9. The fuel injection device according to claim 8 further including a line (119, 45) connecting a piston chamber (118) of said second interruption valve (111) with said lower relief passage (12) in the injector housing (4) and a spring (120) for biasing the valve (111) open.

10. The fuel injection device according to claim 8 further including a spindle (127) on said second interruption valve (111) and which spindle (127) extends from the second control device (50).

11. The fuel injection device according to claim 8 further including a spring (122) for biasing the piston (121) of said auxiliary valve (117) open and from the piston chamber (123) a line (92) to the return line (44) extends through a switching valve (90) and fluidly connects with the line (89) extending between main and auxiliary slides (70, 71).

12. The fuel injection device according claim 1 further including a check valve (55) connecting a passage (64) with the fuel outlet line (15), said check valve (55) being biased to a position blocking off flow to a passage (67) leading to said interruption valve (53) and having a passage (68) permitting flow to said passage (64).

13. The fuel injection device according to claim 1 further including a push rod (96) connecting said lands (77, 78) of the main slide (70) and at least a part of the push rod (96) forms a core (98) of a magnetic coil (97), said magnetic coil (97) being operatively connected with an electric pulse generator (39).

14. The fuel injection device according to claim 13 further including a mechanical blocking device (41) connected to said push rod (96), said blocking device (41) for holding said push rod (96) in a predetermined position.

15. The fuel injection device according to claim 14 further including a camshaft control (110) connected with said control device (38) in said drive system (27), said camshaft control (110) having a camshaft (107) which acts on said push rod (96) of said control device (38).

16. Fuel injection device according to claim 1 wherein said drive system (27) further includes a double-acting axially movable piston (30), a line (35) connecting the work chamber (33) for a piston surface (31) of said piston (30) fully acted on by fluid pressure with the pressure source (37) through the control device (38) and a pressure medium line (36) connecting the ring chamber (34) for a ring surface (32) of said piston (30) directly to the pressure source (37).

* * * * *